United States Patent [19]

Wennerstrom

[11] 4,033,428

[45] July 5, 1977

[54] MUFFLER FOR INTERMITTENT BLASTS OF AIR FROM PNEUMATIC TOOLS, VALVES AND THE LIKE

[75] Inventor: Karl Filip Wennerstrom, Stockholm, Sweden

[73] Assignee: Ab Fi-Wes Maskinservice, Stockholm, Sweden

[22] Filed: Dec. 9, 1975

[21] Appl. No.: 639,050

[30] Foreign Application Priority Data

Dec. 11, 1974 Sweden ..... 7415563

[52] U.S. Cl. ..... 181/36 C; 55/276

[51] Int. Cl.² ..... F01N 3/06

[58] Field of Search ..... 181/36 C, 36 A; 55/276

[56] References Cited

UNITED STATES PATENTS

| | | | |
|---|---|---|---|
| 992,344 | 5/1911 | Donohue | 55/276 |
| 2,325,905 | 8/1943 | Caulfield | 55/276 |
| 2,419,664 | 4/1947 | Tabbert | 181/36 C |
| 3,016,108 | 1/1962 | Myddelton | 181/36 C |
| 3,130,812 | 4/1964 | Hubrich | 55/276 |
| 3,687,225 | 8/1972 | Nelson | 181/36 C |

*Primary Examiner*—Stephen J. Tomsky
*Attorney, Agent, or Firm*—Finnegan, Henderson, Farabow & Garrett

[57] ABSTRACT

A muffler for pneumatic tools in which the lubricating oil from mist lubrication and the like is separated from the used air by means of the air first being led through a porous filler and thereafter allowed to pass through a labyrinth path so as to alter the direction of flow and so as to expand. The oil is separated by means of the air striking against guide means, said oil being allowed to trickle down to the bottom of the muffler where it is drained through a tap or faucet. The air is then led through porous filters so as to remove the last traces of oil so as to be able to be discharged freely into the atmosphere.

16 Claims, 1 Drawing Figure

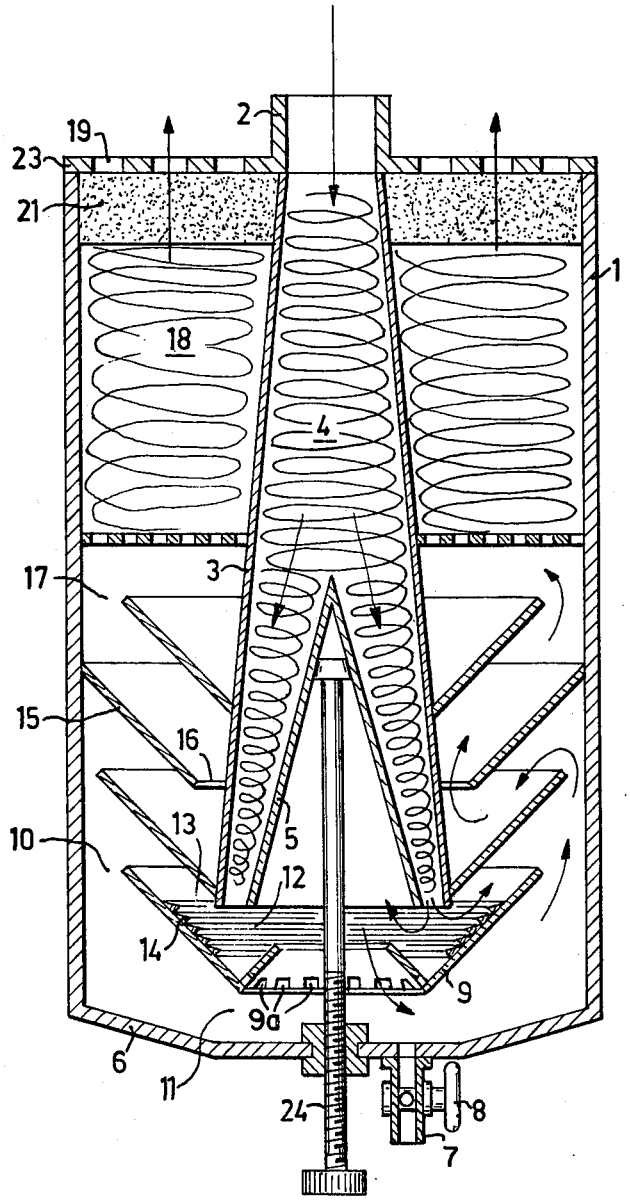
2
19
23
21
1
18
4
3
17
15
16
5
10
13
12
14
9
9a
6
11
24
8
7

MUFFLER FOR INTERMITTENT BLASTS OF AIR FROM PNEUMATIC TOOLS, VALVES AND THE LIKE

Rapid, jerky movements of air normally lead to the development of powerful noise phenomena. Combustion motors and pneumatic tools cause such intermittent blasts of air and resulting extremely powerful noise during use. In the case of combustion motors this is more or less effectively remedied by means of mufflers. When it comes to pneumatic machines and tools, however, no satisfactory muffler has yet been found and attempts have been made to deal with this problem by means of providing people who work with compressed air with hearing protection.

The most commom kinds of mufflers are those intended for automobiles in which the gases passing through the muffler are exhaust gases having high temperatures and containing more or less combusted fuel, oil residues, noxious gases, etc.

In contrast to combustion motors, the outgoing gas from pneumatic machines comprises pure air without any gaseous, noxious substances. Instead, it contains clean lubricating oil from the lubrication of the tools and, possibly, metal particles originating from wear on the machine. Thus, the air can be discharged in an optional manner, even indoors, as long as the oil is removed from the same.

Mufflers for combustion motors and automobiles and mufflers for pneumatic tools do not need to differ in principle from one another as regards construction.

Dimensioning depends on the magnitude of the amounts of gas, which can vary considerably in both cases, as well as the frequency of the blasts of air, which can vary from less than 100 per minute and normally up to 10,000–20,000 per minute. In some cases, however, blast (stroke) frequency can be as much as 350,000 blasts per minute. A common eccentric press for pneumatic operation, for example, operates at aprox. 100 strokes per minute with a stroke volume of approx. 3 litres. The choice of material for the construction of such tools must be totally different from that of automobile exhausts, which attain temperatures of several hundred degrees while the air discharged from pneumatic tools is approximately room temperature or can even be cooled by means of expansion during discharge. This entails that the materials used in the invention according to the present application do not have to be heatresistant. Rather, common plastic materials and commom rubber can be used for the construction when suitable.

Presently, the most common form of lubrication for pneumatic machines is mist lubrication, whereby air for use in the machine is provided with oil mist and thus functions in itself as a lubricant for the movable parts. This lubrication is very effective and results in that the lubricated parts are not heated by developed friction heat. Rather, the used oil will leave the machine totally unaffected. However, an oil surplus must be used in connection with the above-mentioned lubricating method as the oil is blown away during use instead of remaining in the machine for a longer period of time as is the case in normal storage lubrications.

Thus, the discharged air becomes oily and leaves greasy coatings on nearly objects. Oil consumption can also be a factor to reckon with as expensive high-quality oils and large amounts of oil must be used for great speeds between the lubricated surfaces and the high pressures which, in some cases, prevail.

It has also been found that oil from mist lubrication can be a great health hazard. This was unknown until recently. However, a Swedish investigation has shown that very serious allergies, i.a., can arise when the oil mist from mist lubrication is inhaled. it has been known that some people cannot under any conditions work with mist-lubricated eccentric presses. It has now been found, however, that even people who do not appear to be adversely affected by the oil can, in the long run, acquire serious symptoms and damages.

Thus, an oil separator and an oil collector, as well as an oil filter, are arranged in the muffler according to the present invention.

The muffler according to the invention will be described in more detail in connection with the enclosed drawing of an embodiment of a muffler for an eccentric press. The illustrated muffler is cylindrical, but square or rectangular constructions can also be used if, for reasons of positioning and space, it has been found that such forms are more suitable for certain machines.

The muffler in the drawing has a cylindrical outer casing 1 provided with an inlet conduit 2, to which the air discharge from the pneumatic tool is connected. The inlet conduit 2 is dimensioned in relation to the air outlet on the machine or apparatus in question, normally a pipe joint. Naturally it can, when needed, be adapted for lug connection, house coupling etc., whereby the rubber or other such material can be used in connection with the connection as the discharged air is of room temperature or colder.

Inside the muffler, the inlet conduit is transformed into a conically widening tube 3. A porous material or some other air permeable filler such as metal meshing, plastic fibre material, filler bodies, etc. can be placed inside the tube 3 in order to contribute to evening-out the blasts of air so as to obtain a smoother flow. When the air discharged from the tool expands greatly, it is cooled and can therewith be supersaturated with moisture. Thus, it is important that the muffler, and especially the filler, not be sensitive to moisture. Common steel wire cannot be used as it would immediately rust and stop up the tube 3.

Nor can material which is capable of giving off loose fibres be used as the powerful blasts of air loosen the fibres which then deposit themselves in narrow passages, stopping up the same. Thus, a suitable material for this purpose has been found to be woven, knitted or crocheted wire nettings of metals which do not rust.

A distributing cone 5 for the air is arranged at the opening of the tube 3 near the bottom of the muffler. The pointed end of cone 5 projects into the tube 3. The outer casing 1 of the muffler is terminated with a funnel-shaped bottom 6 in which an outlet tube 7 is centrally arranged, said outlet tube 7 being provided with a faucet or tap 8. The inclination of the bottom can be more or less steep, up to 45° or more, but we have found that a 15° inclination is suitable as regards both the drainage of the oil and the air flow through the muffler.

The distributing cone or guide cone 5 is arranged at a distance from the bottom 6 so that air can flow freely therebetween.

The cone 5 distributes the air and directs it towards an annular oil collecting plate 9 having an inclination of approx. 45° towards the side wall 1 and the longitudinal axis of the muffler. A number of annular gaps or slots are formed between the plate 9 and the other construction details, gap 10 being positioned between the plate 9 and the side wall 1 of the muffler, gap 11 between the plate and the bottom 6, gap 12 between the plate and the lower edge of the distributing cone 5 and gap 13 between the plate and the bottom edge of the tube 3.

Thus, the flow of air passing through the muffler passes through the tube 3 with the filler 4 and is guided by the tube wall and guide cone 5 to an annular flow which strikes against the oil collecting plate 9 at the end of the tube 3 and deviates along the plate partially upwards through gap 13 and partially downwards past the bottom edge of the guide cone through gap 12. The downwardly directed flow of air subsequently passes through gap 11 and along the back side of the plate 9 upwards through gap 10 so as to thereafter be united with the air flow passing through gap 13. When striking the plate 9, the oil mist is separated from the air and coats the plate in order to flow downwards through the openings 9*a* and be collected in the bottom 6 in order to be drained or tapped through the outlet tube 7 and the faucet or tap 8.

In order to make the oil separation more effective, the oil collecting plate 9 can be provided with projections or grooves 14 which can be turned, milled or pressed. It was found that the best oil separation is obtained if the grooves 14 in the oil collection plate circumscribe the same parallel to its edges and to the bottom and side wall. Instead of grooves, cylindrical rings of wire netting or metal plating can be soldered or welded concentrically onto the oil collection plate so that the distance between the rings lies between a couple of millimeters and a couple of centimeters. The height of the rings can be made large enough that the rings project above the bottom edge of the guide cone 5 and the bottom edge of the tube 3 so that the air flow passes partly through and partly above the wire netting rings. The oil collection plate 9 can also be folded upwards from the bottom so as to form an edge. A space having an increasing cross section in the direction of the air flow is formed between the outer side of the tube 3 and the wall 1 of the muffler. A number of parallel, conical plate rings or plate shields 15 are positioned in said space, said rings having an approx. 45° inclination towards the wall.

The inner edges of the plate rings 15 are attached to the tube 3 and their outer edges sealingly abut the wall 1 of the muffler, The tube 3 and the plate rings 15 therewith form an insert which can be easily removed together with the lid or cover of the muffler. Every other plate ring has a number of recesses 16 near the tube 3 and the remaining plate rings have corresponding recesses 17 near the muffler wall 1. The air will therewith enter the intermediate space between two rings, for example, near the tube 3 so as to pass through the space between the rings and enter into the next intermediate space near the muffler wall 1. The recesses in the plate rings 15 are designed to increase in size in the flow direction in order to harmonize with the increasing volume of the air flow in the subsequent evened-off air flow.

The plate rings 15 can be constructed of sandwich plates, for example a laminate of two plates having an intermediate plastic layer. In this manner, a muffled plate is obtained which does not vibrate due to the passing air.

In view of the fact that no high temperature exists, the rings can also be made entirely out of plastic or rubber or any other similar material.

The plate rings can be arranged near the front and the top of the muffler, but can also be constituted by a smaller amount of rings which leave a hollow space in the upper portion of the space between the tube 3 and the muffler wall 1.

Said hollow space can be filled with porous material 18 similar to the filler in the tube 3. While the filler 4 in the tube 3 should consist of material having little affinity to oil, for example stainless steel meshing, so that as much oil as possible shall be separated directly when the air blasts strike against the oil separating plate, the filler 18 should instead comprise material having great oil affinity, for example aluminum or copper meshing, glass fibre mesh, plastic mesh or the like. The filler 4 in the tube 3 has the main function of tearing apart the blasts of air and dampening noise, whereas the air flow in the filler 18 is relatively evened-out and the main function of said filler is to separate remaining oil residue from the air.

By means of making the porous material 18 in the space between the tube 3 and the muffler wall 1 out of a material having good oil affinity, the oil will first be absorbed in a thin layer and then drain downwards and be collected in the conical bottom 6 of the muffler along with the oil which is separated from the air as it strikes against the oil separating plate 9. Outlet apertures 19 are arranged uppermost in the muffler in the lid or cover 23. Further oil filters 21 are arranged in front of said outlet apertures in order to absorb the last residues of the oil. As only very small traces of oil accompany the air this far, the filters will have a very long service length. Said filters are suitably filters of active carbon.

In a normal mist lubrication, oil having a viscosity of approximately 5 SAE is used and added to the mist lubricating apparatus in an amount of approximately 1 drop per 40 strokes, i.e. 2–3 drops per minute.

This entails an amount of oil totalling approximately 50 ml per working day and eccentric press which, distributed in mist form, would suffice to pollute very large areas.

The oil can either be collected for later use, or it can also be led directly back to the mist lubricating apparatus via a filter for removal of possible particles. Mist lubrication will therewith function totally automatically with merely an insignificant addition of oil as compensation for the minimal oil loss.

The muffler described above is manufactured so that it is also suitable for a certain amount of air, i.e. it is adapted to a certain machine or a certain tool.

However, it is also possible to construct the muffler according to the invention so that it can be adapted to different amounts of air by means of variably choking the air flow-through passing through the muffler. This can be effected in a simple manner by means of making the cone 5 adjustable in relation to height, for example by means of a screw 24. The screw 24 is suitably applied centrally in the bottom 6 and the oil outlet tube 7 is positioned at its side. The screw is provided with a lock nut and a sealing packing in the bottom 6. By means of turning the screw, it is possible to regulate noise to a minimum level. However, in some cases, a certain counter-pressure may not be exceeded in order that the pneumatic valve or machine shall function properly.

By means of making the air flow-through variable according to the invention it has been found to be possible to arrange a limited number of necessary muffler sizes so that 5–8 otherwise necessary sizes can be replaced by one single size. Manufacture costs have been able to be reduced considerably by means of larger series while the result has remained equally good. It has also been possible to operate the machines in different manner with different air flow-throughs while being able to consistently maintain the same muffler with unchanged noise dampering results.

What I claim is:

1. A muffler for dampening noise from pneumatic tools while simultaneously separating lubricating oil from the used compressed air during expansion thereof comprising a container having an inlet and an outlet for the air;

a tube for guiding the air from said inlet into said container;

an oil-separating plate aligned with the inner end of said tube for impingement thereon by the incoming air and altering the direction of the air flow for extracting a substantial portion of the oil from the air;

labyrinth means for guiding said air flow from said plate toward said outlet, and filter means positioned in said passage and between said labyrinth means and said outlet for passing of the air therethrough for removal of oil from the air before discharge of the air to the atmosphere.

2. A muffler according to claim 1, characterized in that the oil-separating plate has a concave cross section and the inner surfaces of the sides of the plate are provided with grooves or projections for increasing the surface of the plate.

3. A muffler according to claim 1, characterized in that a portion of the plate is perforated and the lower end of the container is provided with drainage tube means for the collected oil, including valve means for releasing the oil.

4. A muffler according to claim 1, characterized in that said labyrinth guide means comprises a plurality of concentric conical, vertically arranged baffles which extend between the tube and the side wall of the container, every other baffle being provided with recesses near the muffler wall, the other baffles being provided with recesses near the tube, the size of the recesses increasing the direction of the air flow so as to guide the air in a labyrinth path of increasing volume.

5. A muffler according to claim 4, characterized in that the baffles are made of plate plastic laminate.

6. A muffler according to claim 4, characterized in that the baffles are made of rubber of plastic.

7. A muffler according to claim 4, characterized in that the filter in the tube comprises a material having low oil affinity, while the filter between the baffles and the outlet comprises material having high oil affinity.

8. A muffler according to claim 7 wherein the filter between said labyrinth guide means and said outlet comprises at least two layers of material in the direction of air flow, the outer layer being active carbon.

9. A muffler according to claim 1, characterized in that the tube, the baffles and the filters are combined in structure which can be inserted into the muffler container during assembly of the muffler.

10. A muffler according to claim 1 wherein said tube increases in cross section inwardly from said inlet and wherein said muffler includes a guide cone positioned in said tube and coaxial therewith, the base of said cone being directed toward the inner end of said tube.

11. A muffler according to claim 10, characterized in that the guide cone is adjustably positionable along the axis of said tube for regulating the counter-passage of the muffler.

12. Muffler according to claim 1, characterized in that said muffler is composed of noise dampening material.

13. A method for dampening noise from the intermittent blasts of compressed air from pneumatic tools and simultaneously removing lubricating oil from the used compressed air comprising the steps of:

channeling the air through a filter having low oil affinity;

impinging the air against a plate for altering the direction of air flow and removing a substantial amount of the oil from the air, the oil adhering to a surface of the plate;

guiding the air through a labyrinth of baffles in an air flow path of increasing volume; and outletting the air to atmosphere through a filter having high oil affinity.

14. The method of claim 13 where the step of channeling includes the steps of gradually increasing the volume of the path of air flow, and then directing the air between inner and outer substantially conical surfaces.

15. The method of claim 14 also including the step of adjusting the relative positions of the inner and outer conical surfaces.

16. The method of claim 13 including the steps of forming the plate for collection of oil therein;

increasing the area of the oil-adhering surface of the plate by forming a plurality of projections thereon; and perforating a portion of the plate for draining the collected oil.

* * * * *

UNITED STATES PATENT AND TRADEMARK OFFICE

CERTIFICATE OF CORRECTION

PATENT NO. : 4,033,428

DATED : July 5, 1977

INVENTOR(S) : Karl Filip Wennerstrom

It is certified that error appears in the above-identified patent and that said Letters Patent are hereby corrected as shown below:

Column 5, line 27, "passage" should be --tube--.

Column 5, line 28, "passing" should be --passage--.

Column 5, line 53, "of" (second occurrence) should be --or--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*